US006425400B1

(12) United States Patent
Krause et al.

(10) Patent No.: US 6,425,400 B1
(45) Date of Patent: Jul. 30, 2002

(54) DEVICE FOR DISPLACING ROD-SHAPED OBJECTS

(75) Inventors: Lothar Krause, Oststeinbek; Dieter Plähn, Barum; Manfred Folger, Hamburg; Joachim Meyer, Handorf; Joachim Kreidelmeyer, Hamburg, all of (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/520,003

(22) Filed: Mar. 6, 2000

(30) Foreign Application Priority Data

Mar. 4, 1999 (DE) ..... 199 09 465

(51) Int. Cl.[7] ..... A24C 1/32; A24C 5/47
(52) U.S. Cl. ..... 131/88; 131/89; 131/280
(58) Field of Search ..... 131/88, 89, 280

(56) References Cited

FOREIGN PATENT DOCUMENTS

| | | |
|---|---|---|
| DE | 1 008 173 | 10/1957 |
| DE | 1 161 507 | 1/1964 |
| EP | 787155 | 12/1957 |
| EP | 0 577 061 A1 | 1/1994 |
| GB | 1 130 752 | 10/1968 |

*Primary Examiner*—Christopher A. Fiorilla
(74) *Attorney, Agent, or Firm*—Venable; Robert Kinberg

(57) ABSTRACT

A device for displacing rod-shaped objects used in the tobacco-processing industry in a direction of the longitudinal axes of the rod-shaped objects includes a revolving conveyor having receptacles each for receiving a plurality of the rod-shaped objects in an axially aligned formation, the rod-shaped objects presenting at least one exposed frontal face. At least one revolving pressing ring is arranged for pressing against the at least one frontal face of the objects in a displacement area, the pressing ring having a spring-elastic material of a silicon material, rubber-elastic plastic material and/or a metallic material. At least one actuating element is arranged in the displacement area for a spring-elastic pressing of the pressing ring against the exposed frontal face objects.

19 Claims, 1 Drawing Sheet

DEVICE FOR DISPLACING ROD-SHAPED OBJECTS

CROSS-REFERENCE TO RELATED APPLICATIONS

Priority is claimed with respect to application Ser. No. 199 09 465.9 filed in Germany on Mar. 4, 1999, the disclosure of which is incorporated herein by reference.

BACKGROUND OF THE INVENTION

The invention relates to a device for displacing rod-shaped objects used in the tobacco-processing industry, in particular cigarettes and/or filters which are located in receptacles of a revolving conveyor, in the direction of their longitudinal axes, the device having a least one revolving pressing ring, which is pressed against at least one frontal face of the objects in a displacement area.

Rod-shaped objects used in the tobacco-processing industry are understood to be cigarettes with and without filters, small cigars, cigars as well as filter rods.

It is sometimes necessary in the course of the production or further processing of the above mentioned rod-shaped objects to displace these objects in the longitudinal direction. It is therefore possible for an object, which is not in the desired position, to be pushed into the latter in the course of the conveyance. An example of this is provided by the preparation of groups of cigarettes and filter plugs for being enclosed by a small glued connecting paper. In the process, two axially aligned cigarettes are transferred into a receptacle of a revolving conveyor, for example a rotating drum. Then an axially aligned filter plug of twice the normally used length is placed between the two axially aligned cigarettes in the receptacle. In order to assure a trouble-free placement of the filter plug, spaces exist between the cigarettes and the filter plug of a group, which must be removed by the axial displacement of the cigarettes, so that the components consisting of cigarettes and filter plug of a group are brought together and touch each other. A suitable displacement mechanism is described in German Letters Patent 1 008 173, wherein so-called wobble rings are fastened by means of a plurality of springs on the hub of a drum which conveys the groups in troughs. Actuating elements at a displacement location push the rings in the direction toward the groups, wherein the rings displace the cigarettes located on the outside toward the filter plug located between them. Downstream of the displacement location the springs push the rings back again, so that fresh groups of objects can be received in the troughs after the pushed-together groups have been transported away. This type of a resilient suspension of the displacement ring via a number of springs is mechanically delicate and is not trouble-free, particularly at high speeds, because of the springs alone, which tend to break often.

SUMMARY OF THE INVENTION

An object of the invention is to provide a mechanically sturdy displacement device which eliminates trouble caused by spring breakage of the existing device and is suitable for high speeds.

The above and other objects are accomplished according to the invention by the provision of a device for displacing rod-shaped objects used in the tobacco-processing industry, in particular cigarettes and/or filters, in a direction of the longitudinal axes of the rod-shaped objects, comprising: a revolving conveyor having receptacles each for receiving a plurality of the rod-shaped objects in an axially aligned formation, the rod-shaped objects presenting at least one exposed frontal face; at least one revolving pressing ring arranged for pressing against the at least one frontal face of the objects in a displacement area, the pressing ring comprised at least partially of a spring-elastic material selected from a group consisting of a silicon material, rubber-elastic plastic material and a metallic material.

A particularly advantageous further development of the invention consists in an embodiment of the conveyor as a revolving, i.e. rotating, drum, which is provided with troughs in which the objects are conveyed, so that they can be displaced in the direction of their longitudinal axes. In this case the pressing ring then preferably revolves synchronously with the drum. In a further development of the invention, the pressing ring is fastened in a preferably inner circular end area on a hub of the drum. This results in a mechanically very sturdy displacement device contrasted to known devices.

An important further development of the device in accordance with the invention is distinguished in that the pressing ring has a concave shape on the side facing away from the drum, i.e. that it has a concave recess. With such a design of the pressing ring the latter can be deformed easily and with little wear by the actuating element. A further advantageous embodiment of the invention resides in the fastening of an outer ring consisting of a rigid material, for example metal, on the outer end area of the pressing ring made of silicon. The rigid outer ring can advantageously have an opening in the area of the front face of an object.

In the above mentioned special use of the invention, namely in connection with a displacement drum for cigarette-filter groups, pressing rings with actuating elements are advantageously provided on both sides of the revolving conveyor.

Besides the preferred silicon material for the pressing rings, the invention also relates to pressing rings made of a similar suitable spring-elastic material, for example a rubber-elastic plastic material, or a corresponding metallic material.

The particular advantage of the invention lies in that the pressing ring itself can be resiliently designed, but still be of sufficient sturdiness, so that it operates with sufficient dependability even at high speeds. The use of silicon has the additional advantage that it is quite harmless in view of food safety regulations, even if small particles should get into the objects.

BRIEF DESCRIPTION OF THE DRAWINGS

The invention will be explained in greater detail by means of an exemplary are in.

DETAILED DESCRIPTION OF THE INVENTION

Figure 1:
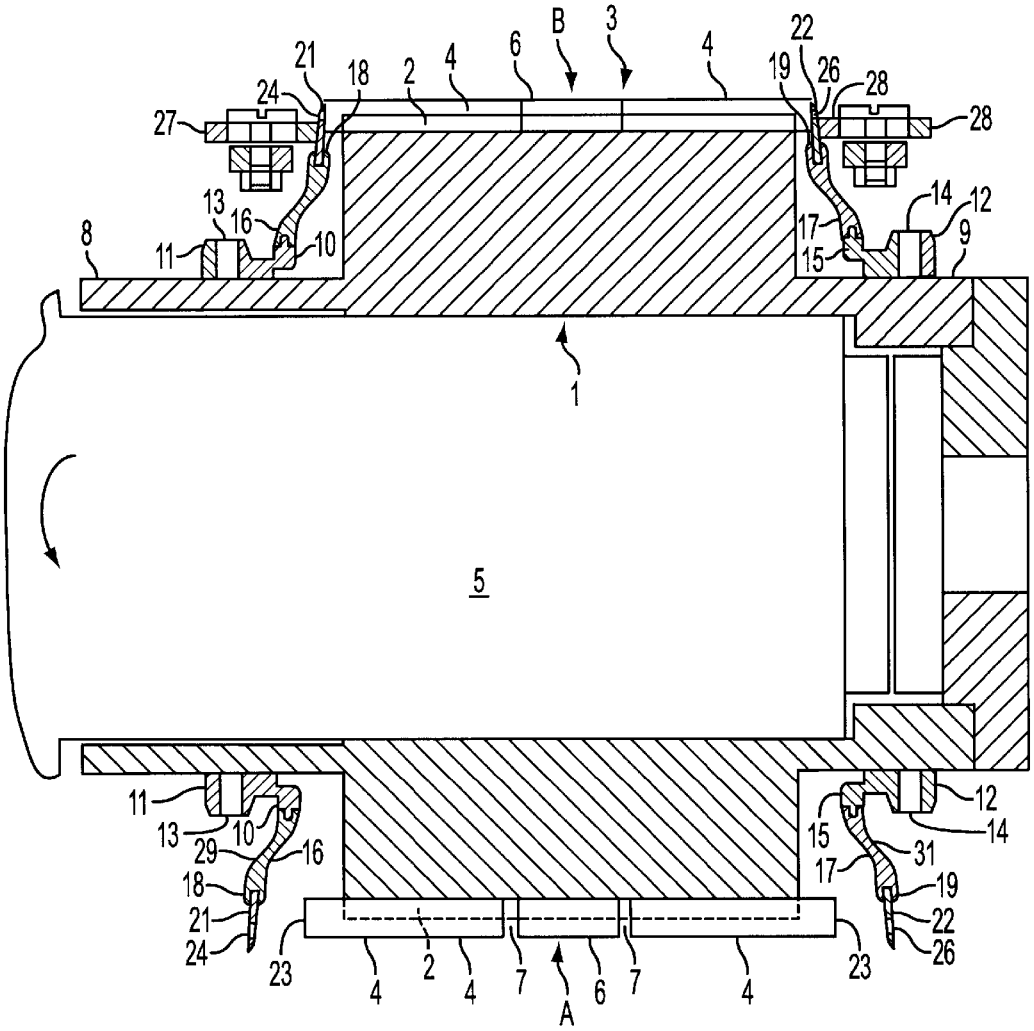
FIG. 1 is a cross section of a so-called assembly drum for groups of cigarettes and filter plugs in a filter attachment machine having displacement devices in accordance with the invention.

Referring to FIG. 1, there is shown a revolving conveyor in the form of a so-called rotating assembly drum 1, known per se, in a customary filter attachment machine, not shown in further detail, whose troughs 2 are provided with groups 3, respectively consisting of cigarettes 4 and a filter plug 6 arranged between them, by a feed drum, not represented, in an area A. In the course of feeding the groups 3, spaces 7 are required between components 4 and 6, which must be removed by pushing the components together for further processing, namely the enclosure, not represented, of the filter plugs 6 and the adjoining areas of the cigarettes 4 by a small glued connecting paper for the purpose of producing filter cigarettes. The groups are represented in a pushed-together position in a displacement area B, in which they proceed to further processing. The components of the group B are maintained in place by suction air, which generates an underpressure in the troughs along the circumferences of the components in a known manner by means of suction channels, not represented. The underpressure is of sufficient force for maintaining the groups in the troughs, but will permit axial displacement.

Figure 2:
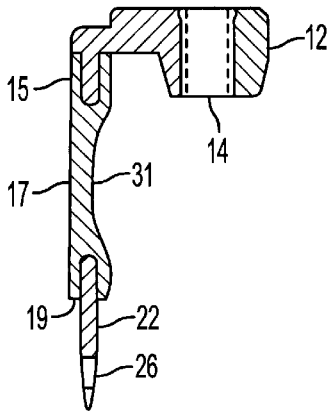
FIG. 2 shows a detail from FIG. 1 with an actuating element.

With further reference to FIG. 2, holders 11 and 12 are screwed or clamped by means of screws, not represented, to threaded bores 13 and 14, respectively, of respective hubs 8 and 9 of drum 1 seated on a shaft 5. The inner areas 10, 15 of pressing rings 16, 17, respectively, are fastened on the holders, and outer rings 21, 22, respectively, made of a relatively rigid material (metal or plastic) are fastened on their outer areas 18, 19, respectively 19. The ring-shaped pressing elements 16, 17 are made of a spring-elastic silicon material, or of another material made of a correspondingly elastic plastic material or metal, which is quite harmless in view of food safety regulations, even if small particles should get into the cigarettes and would be burned with them. The outer rings 21 and 22 are provided with openings 24, 26, respectively, in the areas which push on the frontal faces 23 of the cigarettes 4 for displacing them. Actuating elements for the spring-elastic deformation of the pressing rings 16 and 17 in the displacement area B are embodied as stationarily arranged rotatable rollers 27, 28, respectively. The deformation of the pressing rings 16, 17 can be seen from their position in the area A (no deformation) and in the area B (full deformation) On their sides facing away from the drum, the pressing rings 16 and 17 have been provided with recesses 29, 31, respectively, which make the spring-elastic deformations easier by means of the actuating elements 27, 28, respectively.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for displacing rod-shaped objects used in the tobacco-processing industry in a direction of the longitudinal axes of the rod-shaped objects, comprising:

a revolving conveyor having receptacles each for receiving a plurality of the rod-shaped objects in an axially aligned formation, the rod-shaped objects presenting at least one exposed frontal face;

at least one revolving pressing ring arranged for pressing against the at least one frontal face of the objects in a displacement area, the pressing ring comprised at least partially of a spring-elastic material comprising a silicon material; and at least one actuating element in the displacement area arranged for a spring-elastic pressing of the pressing ring against the exposed frontal face objects.

2. The device in accordance with claim 1, wherein the revolving conveyor comprises a rotating drum having troughs constituting the receptacles in which the objects are conveyed so that they can be displaced in the direction of their longitudinal axes.

3. The device in accordance with claim 2, wherein the pressing ring is arranged to revolve synchronously with the drum (1).

4. The device in accordance with claim 3, wherein the drum includes a hub having an inner end area and the pressing ring is fastened in the inner end area on the hub.

5. The device in accordance with claim 4, wherein the pressing ring is concavely shaped on a side facing away from the drum.

6. The device in accordance with claim 1, wherein the pressing ring has an outer end area and further including an outer ring comprised of a rigid material fastened on the outer end area of the pressing ring.

7. The device in accordance with claim 6, wherein the outer ring has an opening in the area of the exposed frontal face of the objects.

8. The device in accordance with claim 1, wherein the actuating element is a stationarily arranged rotatable roller which spring-elastically deforms the pressing ring in the displacement area.

9. The device in accordance claim 1, wherein the axially aligned rod-shaped objects present oppositely directed exposed frontal faces, the at least one pressing ring comprises pressing rings arranged on both sides of the revolving conveyor, and the actuating element comprises actuating elements arranged on both sides of the revolving conveyor for pressing the respective pressing rings against the respective exposed frontal faces of the rod-shaped objects.

10. The device in accordance with claim 1, wherein the objects consist of groups of cigarettes and filter plugs which must be axially pushed together.

11. A device for displacing rod-shaped objects used in the tobacco-processing industry in a direction of the longitudinal axes of the rod-shaped objects, comprising:

a revolving conveyor having receptacles each for receiving a plurality of the rod-shaped objects in an axially aligned formation, the rod-shaped objects presenting at least one exposed frontal face, wherein the revolving conveyor comprises a rotating drum having troughs constituting the receptacles in which the objects are conveyed so that they can be displaced in the direction of their longitudinal axes;

at least one revolving pressing ring arranged for pressing against the at least one frontal face of the objects in a displacement area, the pressing ring comprised at least partially of a spring-elastic material selected from a group consisting of a silicon material, rubber-elastic plastic material and a metallic material, wherein the pressing ring is arranged to revolve synchronously with the drum and is concavely shaped on a side facing away from the drum, wherein the drum includes a hub having an inner end area and the pressing ring is fastened in the inner end area on the hub; and at least one actuating element in the displacement area arranged for a spring-elastic pressing of the pressing ring against the exposed frontal face objects.

12. The device in accordance with claim 11, wherein the actuating element is a stationarily arranged rotatable roller which spring-elastically deforms the pressing ring in the displacement area.

13. The device in accordance claim 11, wherein the axially aligned rod-shaped objects present oppositely directed exposed frontal faces, the at least one pressing ring comprises pressing rings arranged on both sides of the revolving conveyor, and the actuating element comprises actuating elements arranged on both sides of the revolving conveyor for pressing the respective pressing rings against the respective exposed frontal faces of the rod-shaped objects.

14. The device in accordance with claim 11, wherein the objects consist of groups of cigarettes and filter plugs which must be axially pushed together.

15. A device for displacing rod-shaped objects used in the tobacco-processing industry in a direction of the longitudinal axes of the rod-shaped objects, comprising:

a revolving conveyor having receptacles each for receiving a plurality of the rod-shaped objects in an axially aligned formation, the rod-shaped objects presenting at least one exposed frontal face;

at least one revolving pressing ring arranged for pressing against the at least one frontal face of the objects in a displacement area, the pressing ring comprised at least partially of a spring-elastic material selected from a group consisting of a silicon material, rubber-elastic plastic material and a metallic material, wherein the pressing ring has an outer end area;

an outer ring comprised of a rigid material fastened on the outer end area of the pressing ring; and at least one actuating element in the displacement area arranged for a spring-elastic pressing of the pressing ring against the exposed frontal face objects.

16. The device in accordance with claim 15, wherein the outer ring has an opening in the area of the exposed frontal face of the objects.

17. The device in accordance with claim 15, wherein the actuating element is a stationarily arranged rotatable roller which spring-elastically deforms the pressing ring in the displacement area.

18. The device in accordance claim 15, wherein the axially aligned rod-shaped objects present oppositely directed exposed frontal faces, the at least one pressing ring comprises pressing rings arranged on both sides of the revolving conveyor, and the actuating element comprises actuating elements arranged on both sides of the revolving conveyor for pressing the respective pressing rings against the respective exposed frontal faces of the rod-shaped objects.

19. The device in accordance with claim 15, wherein the objects consist of groups of cigarettes and filter plugs which must be axially pushed together.

* * * * *